US009285106B2

(12) United States Patent
Tian

(10) Patent No.: US 9,285,106 B2
(45) Date of Patent: Mar. 15, 2016

(54) ROTARY OPTICALLY CONTROLLED LED NIGHT LAMP

(71) Applicant: Chuanjia Tian, Guangdong (CN)

(72) Inventor: Chuanjia Tian, Guangdong (CN)

(73) Assignee: DONGGUAN CHUAN JIA INDUSTRIAL CO.LTD, Dongguan, Guangdong (CN)

( * ) Notice: Subject to any disclaimer, the term of this patent is extended or adjusted under 35 U.S.C. 154(b) by 271 days.

(21) Appl. No.: 13/933,108

(22) Filed: Jul. 1, 2013

(65) Prior Publication Data

US 2014/0369074 A1 Dec. 18, 2014

(30) Foreign Application Priority Data

Jun. 14, 2013 (CN) ..... 2013 2 0342331 U

(51) Int. Cl.

| | |
|---|---|
| ***F21V 23/04*** | (2006.01) |
| ***F21S 8/00*** | (2006.01) |
| ***F21V 37/00*** | (2006.01) |
| *F21V 21/30* | (2006.01) |

(52) U.S. Cl.

CPC ..... *F21V 23/0464* (2013.01); *F21S 8/035* (2013.01); *F21V 23/0442* (2013.01); *F21V 37/0095* (2013.01); *F21V 21/30* (2013.01)

(58) Field of Classification Search

CPC ..... F21S 8/035
USPC ..... 362/640–659; 439/11
See application file for complete search history.

(56) References Cited

U.S. PATENT DOCUMENTS

| | | | | | |
|---|---|---|---|---|---|
| 5,352,122 | A * | 10/1994 | Speyer et al. | 439/13 |
| 5,683,254 | A * | 11/1997 | Lin | 439/11 |
| 5,727,953 | A * | 3/1998 | Pasholk | 439/21 |
| 5,954,519 | A * | 9/1999 | Hsiao | 439/21 |
| 6,093,028 | A * | 7/2000 | Yang | 439/13 |
| 6,488,510 | B2 * | 12/2002 | Li | 439/13 |
| 6,576,852 | B1 * | 6/2003 | Shu | 200/51 R |
| 7,712,915 | B2 * | 5/2010 | Liu | 362/183 |
| 8,133,059 | B1 * | 3/2012 | Hsiao | 439/11 |
| 8,147,097 | B1 * | 4/2012 | Hsiao | 362/288 |
| 8,147,116 | B1 * | 4/2012 | Hsiao | 362/640 |
| 2003/0076680 | A1 * | 4/2003 | Stekelenburg | H01R 24/68 362/276 |
| 2006/0171141 | A1 * | 8/2006 | Tsai | 362/95 |
| 2013/0044518 | A1 * | 2/2013 | Yang | 362/641 |

* cited by examiner

*Primary Examiner* — Evan Dzierzynski
*Assistant Examiner* — Zheng Song

(57) ABSTRACT

A rotary optically controlled LED night lamp includes: a body; and a rotary plug holder connected to the body; wherein the body has an upper portion and a lower portion, the lower portion has a containing space, an optically controlled switch is provided inside the containing space; a round slot is provided on the lower portion, location flanges are provided on the round slot; wherein the rotary plug holder includes: a holder body; and a rotary connector connected to the holder body; wherein location slots engaged with the location flanges are provided on the holder body. An LED is connected to the optically controlled switch in such a manner that the LED is controlled optically; the location flanges are engaged with the location slots in such a manner that the night lamp can rotate for 360° freely for solving a illuminating angle locating problem.

19 Claims, 4 Drawing Sheets

ROTARY OPTICALLY CONTROLLED LED NIGHT LAMP

BACKGROUND OF THE PRESENT INVENTION

1. Field of Invention

The present invention relates to a technical field of lamps, and more particularly to a rotary optically controlled LED (light emitting diode) night lamp which can be assembled conveniently, rotates to a position rapidly and has a high sensitivity of light.

2. Description of Related Arts

A conventional night lamp, as a lamp product, is mainly utilized for decoration, and is also utilized for lighting; with gradually increasing living levels, a variety of the night lamps are desired to meet requirements of interior decoration in addition to the requirements of lighting. The conventional household night lamp is a small lamp product which can be directly plugged into a socket. As an example, the Chinese patent application 201120000990.0 disclosed a rotary night lamp comprising: a holder having a top portion and a relative bottom portion, wherein the bottom portion has a concave containing space; a plug having a first end with two metal slices and having a second end with a rotary connector, wherein the rotary connector is engaged with the concave containing space and is capable of rotating for 360° in the concave containing space; a bulb provided on a third surface of the holder; and a switch unit provided inside the holder, comprising a switch (non-contacting type or contacting type), wherein the switch is exposed on the top portion of the holder; wherein the metal slices is electrically connected to the switch unit and the bulb. The foregoing structure is complex and is difficult to be assembled, and the cost is high. Therefore, the rotary night lamp should be further improved. As another example, the Chinese patent application 201220104130.6 disclosed a rotary night lamp holder comprising: a body; a holder unit; a bulb connector, a first electrode conductive slice and a second electrode conductive slice, wherein a ringlike connecting conductive slice is provided inside the body, the holder unit comprises a holder, a first power plug and a second power plug, wherein the holder is rotatably connected inside the body, and the first power plug is connected to the second electrode conductive, the second power plug is connected to the ringlike connecting conductive slice. The foregoing structure is simplified, assembling procedures and cost are decreased, and the holder unit rotates for 360° for adapting to a socket at any direction and being utilized conveniently; at the meantime, a scale is provided inside the body for indicating a rotation angle; therefore, the holder can be easily rotated to a predetermined angle while being utilized and each angle has a corresponding graduation for indicating the rotation angle effectively; further more, its adjustment is easy, rotation is accurate and time is saved.

SUMMARY OF THE PRESENT INVENTION

An object of the present invention is to provide a low cost rotary optically controlled LED night lamp which can overcome disadvantages of conventional technologies.

Accordingly, in order to accomplish the above object, the present invention provides a rotary optically controlled LED night lamp, comprising:

a body; and a rotary plug holder connected to a bottom of the body;

wherein the body has an upper portion and a lower portion, a location connector and a plurality of location columns are provided on a bottom of the upper portion, an upper lamp holder body is provided on a left of the upper portion; the lower portion has a containing space, an optically controlled switch is provided inside the containing space, a first electrode conductive slice and a second electrode conductive slice are connected to the optically controlled switch, a lower lamp holder body is provided on a left of the lower portion; a first outer front portion of the upper lamp holder and a second outer front portion of the lower lamp holder are cased by a lantern ring, a round slot is provided in a middle of a bottom of the lower portion, a connection column is provided in a middle of the round slot; a first plug connection hole, a second plug connection hole and a location connection hole are respectively provided on a front, a back and a right of the connection column;

wherein the rotary plug holder comprises:

a holder body; and a first power plug and a second power plug connected to the holder body;

wherein a location hole is provided in a middle of the holder body and connected to a rotary connector inside an inner space of a top portion of the holder body; an inner case is provided in a middle of an inner space of a top portion of the rotary connector, an outer case is provided on an outer portion of the rotary connector, an outer portion of the inner case is cased by an inner metal ring, an outer portion of the outer case is cased by an outer metal ring; a top of the first power plug and a top of the second power plug are respectively contacted with an inner circle surface of the outer metal ring and an inner circle surface of the inner metal ring.

Preferably, a plurality of location flanges are provided on the round slot, a plurality of location slots engaged with the location flanges are provided on the top portion of the rotary connector.

Preferably, the optically controlled switch comprises a PCB (printed circuit board) and a light sensor electrically connected to the PCB, a sensitive slice is connected to a top of the light sensor.

Preferably, an LED is connected to a left of the PCB.

Preferably, a number of the location flanges is 2~8; a number of the location slot is 4~8.

Preferably, a bottom of the first electrode conductive slice and a bottom of the second electrode conductive slice respectively pass through the first plug connection hole and the second plug connection hole on the bottom of the lower portion, and are respectively electrically connected to the inner circle surface of the outer metal ring and an outer circle surface of the inner metal ring.

Preferably, a plurality of the location slots engaged with the location flanges of the round slot on the bottom of the lower portion are provided on an outer circle surface of the top portion of the holder body; and the rotary plug holder can smoothly rotate for 360° in the round slot on the bottom of the lower portion; the location flanges are engaged with the location slots for locking a location of the night lamp.

Preferably, the location connection hole of the round slot of the lower portion is connected to the location connector on the bottom of the upper portion by a first location screw.

Preferably, the location hole in the middle of the holder body is connected to the connection column in the middle of the bottom of the lower portion by a second location screw; the second location screw is cased by a location spring.

Preferably, the first electrode conductive slice and the second electrode conductive slice turns on or off an electrical connection through the optically controlled switch.

Therefore, the present invention has advantages as follows: when compared with the conventional optically controlled night lamp or rotary night lamp, the LED is provided in a structure of the night lamp and is connected to the optically controlled switch in such a manner that the LED is controlled optically and a practicality of the night lamp is increased; a rotary connection method of the rotary plug holder and the lower portion is more simple, only two screws are needed for assembling and locating, and a number of the metal slices is decreased as well as a cost; it is more creative that the location flanges are provided on the bottom of the lower portion, the location flanges are engaged with the location slots on the outer circle surface of the top portion of the holder body in such a manner that the night lamp can rotate for 360° freely for solving a illuminating angle locating problem of the night lamp.

These and other objectives, features, and advantages of the present invention will become apparent from the following detailed description, the accompanying drawings, and the appended claims.

DETAILED DESCRIPTION OF THE PREFERRED EMBODIMENT

Figure 1:
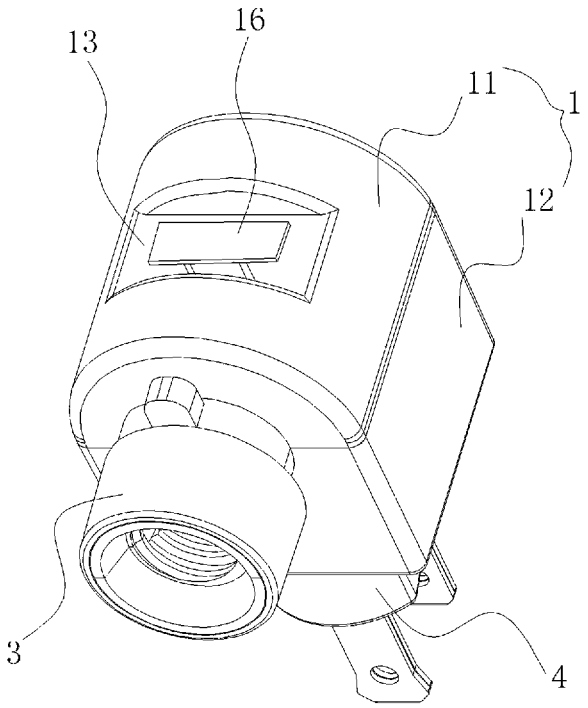
FIG. 1 is a perspective view of the rotary optically controlled LED night lamp according to a preferred embodiment of the present invention.
Figure 2:
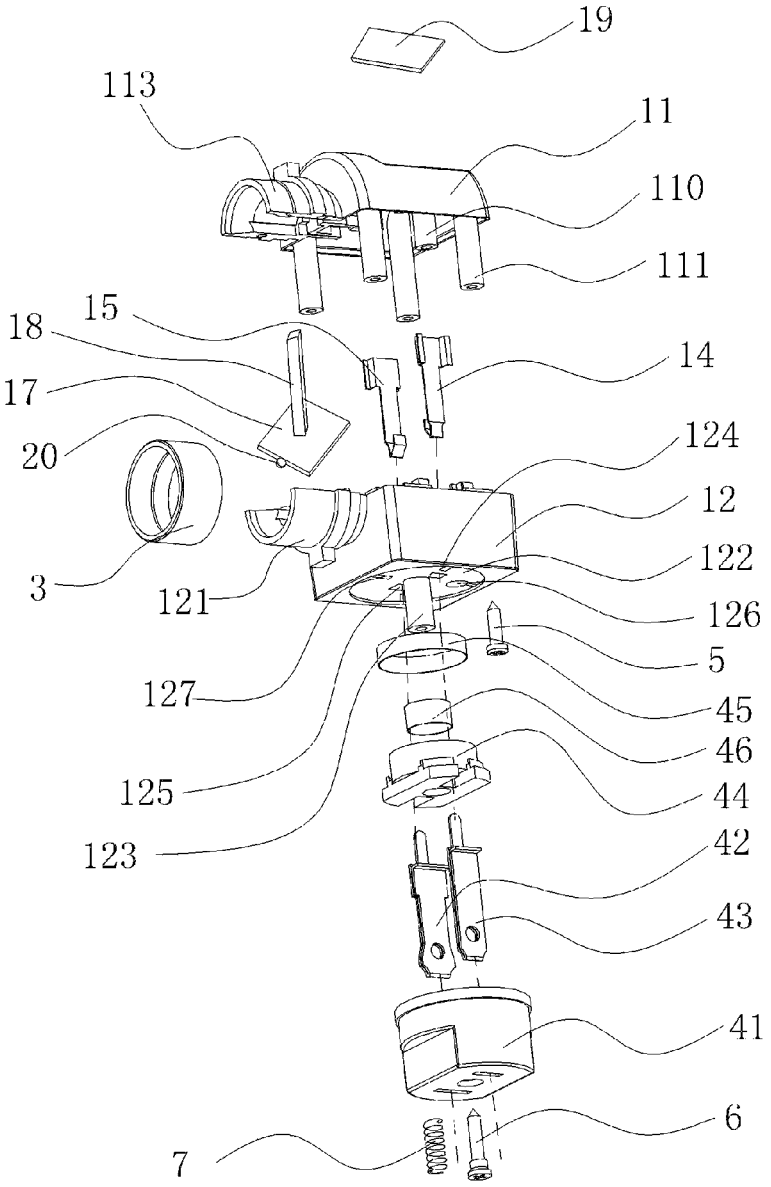
FIG. 2 is an exploded view of the rotary optically controlled LED night lamp according to the preferred embodiment of the present invention.
Figure 3:
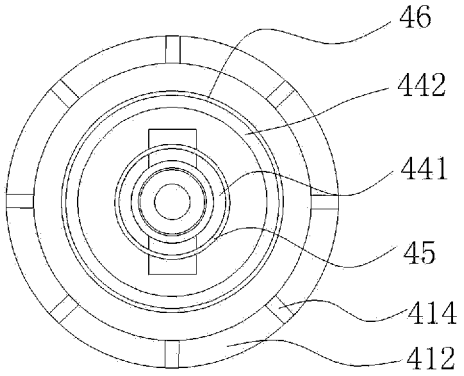
FIG. 3 is a top view of the rotary plug holder of the rotary optically controlled LED night lamp according to the preferred embodiment of the present invention.
Figure 4:
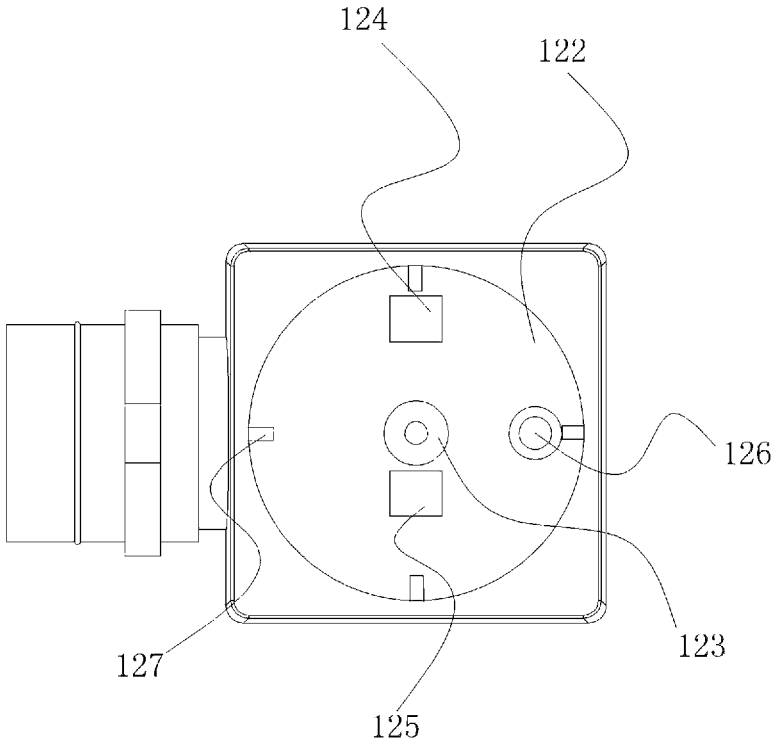
FIG. 4 is a bottom view of the lower portion of the rotary optically controlled LED night lamp according to the preferred embodiment of the present invention.

Referring to FIG. 1 to FIG. 4 of the drawings, a rotary optically controlled LED night lamp according to a preferred embodiment of the present invention is illustrated, comprising:

a body 1; and a rotary plug holder 4 connected to a bottom of the body 1;

wherein the body 1 has an upper portion 11 and a lower portion 12, a location connector 110 and a plurality of location columns 111 are provided on a bottom of the upper portion 11, an upper lamp holder body 113 is provided on a left of the upper portion 11; the lower portion 12 has a containing space, an optically controlled switch 16 is provided inside the containing space, a first electrode conductive slice 14 and a second electrode conductive slice 15 are connected to the optically controlled switch 16, a lower lamp holder body 121 is provided on a left of the lower portion 12; a first outer front portion of the lower lamp holder 121 and a second outer front portion of the upper lamp holder 113 are cased by a lantern ring 3, a round slot 122 is provided in a middle of a bottom of the lower portion 12, a connection column 123 is provided in a middle of the round slot 122; a first plug connection hole 124, a second plug connection hole 125 and a location connection hole 126 are respectively provided on a front, a back and a right of the connection column 123; four location flanges 127 are respectively provided on a front, a back, a left and a right of the round slot 122;

wherein the rotary plug holder 4 comprises:

a holder body 41; and a first power plug 42 and a second power plug 43 connected to the holder body 41;

wherein a location hole 40 is provided in a middle of the holder body 41 and connected to a rotary connector 44 inside an inner space of a top portion of the holder 41 body; an inner case 441 is provided in a middle of an inner space of a top portion of the rotary connector 44, an outer case 442 is provided on an outer portion of the rotary connector 44, an outer portion of the inner case 441 is cased by an inner metal ring 45, an outer portion of the outer case 442 is cased by an outer metal ring 46; a top of the first power plug 42 and a top of the second power plug 43 are respectively contacted with an inner circle surface of the outer metal ring 46 and an inner circle surface of the inner metal ring 45.

Preferably, the optically controlled switch 16 comprises a PCB 17 and a light sensor 18 electrically connected to the PCB, a sensitive slice 19 is connected to a top of the light sensor 18.

Preferably, an LED 20 is connected to a left of the PCB 17.

Preferably, a bottom of the first electrode conductive slice 14 and a bottom of the second electrode conductive slice 15 respectively pass through the first plug connection hole 124 and the second plug connection hole on the bottom of the lower portion 12, and are respectively electrically connected to the inner circle surface of the outer metal ring 46 and an outer circle surface of the inner metal ring 45.

Preferably, a plurality of the location slots 414 engaged with the location flanges 127 of the round slot 122 on the bottom of the lower portion 12 are provided on an outer circle surface 412 of the top portion of the holder body 41; and the rotary plug holder 4 can smoothly rotate for 360° in the round slot 122 on the bottom of the lower portion 12; the location flanges 127 are engaged with the location slots 414 for locking a location of the night lamp.

Preferably, the location connection hole 126 of the round slot 122 of the lower portion 12 is connected to the location connector 110 on the bottom of the upper portion 11 by a first location screw 5.

Preferably, the location hole 40 in the middle of the holder body 41 is connected to the connection column 123 in the middle of the bottom of the lower portion 12 by a second location screw 6; the second location screw 6 is cased by a location spring 7.

Preferably, the first electrode conductive slice 14 and the second electrode conductive slice 15 turns on or off an electrical connection through the optically controlled switch 16.

With the foregoing structure, the sensitive slice 19 and the light sensor 18 of the optically controlled switch 16 detect a difference of ambient light through a loophole for controlling the LED 20; the location flanges 127 are provided on the bottom of the lower 12 portion, the location flanges 127 are engaged with the location slots 414 on the outer circle surface of the top portion of the holder body 41 in such a manner that the night lamp can rotate freely.

One skilled in the art will understand that the embodiment of the present invention as shown in the drawings and described above is exemplary only and not intended to be limiting.

It will thus be seen that the objects of the present invention have been fully and effectively accomplished. Its embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A rotary optically controlled LED night lamp, comprising:

a body; and a rotary plug holder connected to a bottom of said body;

wherein said body has an upper portion and a lower portion, a location connector and a plurality of location columns are provided on a bottom of said upper portion, an upper lamp holder body is provided on a left of said upper portion; said lower portion has a containing space, an optically controlled switch is provided inside said containing space, a first electrode conductive slice and a second electrode conductive slice are connected to said optically controlled switch, a lower lamp holder body is provided on a left of said lower portion; a first outer front portion of said upper lamp holder and a second outer front portion of said lower lamp holder are cased by a lantern ring, a round slot is provided in a middle of a bottom of said lower portion, a connection column is provided in a middle of said round slot; a first plug connection hole, a second plug connection hole and a location connection hole are respectively provided on a front, a back and a right of said connection column;

wherein said rotary plug holder comprises:

a holder body; and a first power plug and a second power plug connected to said holder body;

wherein a location hole is provided in a middle of said holder body and connected to a rotary connector inside an inner space of a top portion of said holder body; wherein an inner case is provided in a middle of an inner space of a top portion of said rotary connector, an outer case is provided on an outer portion of said rotary connector, an outer portion of said inner case is cased by an inner metal ring, an outer portion of said outer case is cased by an outer metal ring; a top of said first power plug and a top of said second power plug are respectively contacted with an inner circle surface of said outer metal ring and an inner circle surface of said inner metal ring;

wherein a plurality of location flanges are provided on said round slot, a plurality of location slots engaged with said location flanges are provided on an outer circle surface of said top portion of said holder body, a location screw is provided inside said location hole, said location screw is cased by a location spring; and said rotary plug holder smoothly rotates 360° in said round slot on said bottom of said lower portion; said location flanges are engaged with said location slots for locking a location of said night lamp.

2. The rotary optically controlled LED night lamp, as recited in claim 1, wherein said optically controlled switch comprises a PCB and a light sensor electrically connected to said PCB, a sensitive slice is connected to a top of said light sensor.

3. The rotary optically controlled LED night lamp, as recited in claim 2, wherein a bottom of said first electrode conductive slice and a bottom of said second electrode conductive slice respectively pass through said first plug connection hole and said second plug connection hole on said bottom of said lower portion, and are respectively electrically connected to said inner circle surface of said outer metal ring and an outer circle surface of said inner metal ring.

4. The rotary optically controlled LED night lamp, as recited in claim 3, wherein said location connection hole of said round slot of said lower portion is connected to said location connector on said bottom of said upper portion by a first location screw.

5. The rotary optically controlled LED night lamp, as recited in claim 4, wherein said location hole in said middle of said holder body is connected to said connection column in said middle of said bottom of said lower portion by a second location screw; said second location screw is cased by a location spring.

6. The rotary optically controlled LED night lamp, as recited in claim 5, wherein said first electrode conductive slice and said second electrode conductive slice turns on or off an electrical connection through said optically controlled switch.

7. The rotary optically controlled LED night lamp, as recited in claim 2, wherein an LED is connected to a left of said PCB.

8. The rotary optically controlled LED night lamp, as recited in claim 7, wherein a number of said location flanges is 2~8; a number of said location slot is 4~8.

9. The rotary optically controlled LED night lamp, as recited in claim 2, wherein a number of said location flanges is 2~8; a number of said location slot is 4~8.

10. The rotary optically controlled LED night lamp, as recited in claim 2, wherein said location connection hole of said round slot of said lower portion is connected to said location connector on said bottom of said upper portion by a first location screw.

11. The rotary optically controlled LED night lamp, as recited in claim 4, wherein said location hole in said middle of said holder body is connected to said connection column in said middle of said bottom of said lower portion by a second location screw; said second location screw is cased by a location spring.

12. The rotary optically controlled LED night lamp, as recited in claim 2, wherein said first electrode conductive slice and said second electrode conductive slice turns on or off an electrical connection through said optically controlled switch.

13. The rotary optically controlled LED night lamp, as recited in claim 1, wherein an LED is connected to a left of said PCB.

14. The rotary optically controlled LED night lamp, as recited in claim 13, wherein a number of said location flanges is 2~8; a number of said location slot is 4~8.

15. The rotary optically controlled LED night lamp, as recited in claim 1, wherein a number of said location flanges is 2~8; a number of said location slot is 4~8.

16. The rotary optically controlled LED night lamp, as recited in claim 1, wherein a bottom of said first electrode conductive slice and a bottom of said second electrode conductive slice respectively pass through said first plug connection hole and said second plug connection hole on said bottom of said lower portion, and are respectively electrically connected to said inner circle surface of said outer metal ring and an outer circle surface of said inner metal ring.

17. The rotary optically controlled LED night lamp, as recited in claim 1, wherein said location connection hole of said round slot of said lower portion is connected to said location connector on said bottom of said upper portion by a first location screw.

18. The rotary optically controlled LED night lamp, as recited in claim 11, wherein said location hole in said middle of said holder body is connected to said connection column in said middle of said bottom of said lower portion by a second location screw; said second location screw is cased by a location spring.

19. The rotary optically controlled LED night lamp, as recited in claim 1, wherein said first electrode conductive slice and said second electrode conductive slice turns on or off an electrical connection through said optically controlled switch.

* * * * *